United States Patent [19]

Schmidt

[11] 4,354,320

[45] Oct. 19, 1982

[54] SNOW PLOW FOR RAILED VEHICLE

[76] Inventor: Alfred Schmidt, Friedrichstrasse 17, D-7822 St. Blasien, Fed. Rep. of Germany

[21] Appl. No.: 191,408

[22] Filed: Sep. 29, 1980

[30] Foreign Application Priority Data

Nov. 24, 1979 [DE] Fed. Rep. of Germany ..... 2947396

[51] Int. Cl.[3] ..... E01H 8/06

[52] U.S. Cl. ..... 37/213; 37/259; 172/98; 172/667

[58] Field of Search ..... 37/22, 24, 43 D, 43 R, 37/43 E, 43 G; 172/98, 119, 795, 476, 667, 673, 741

[56] References Cited

U.S. PATENT DOCUMENTS

| | | | |
|---|---|---|---|
| 1,413,007 | 4/1922 | Curtis | 37/24 |
| 1,775,314 | 9/1930 | Mahoney et al. | 172/476 |
| 2,216,782 | 10/1940 | Klaver | 37/43 R |
| 2,504,774 | 4/1950 | Williamson | 37/43 R |
| 3,766,586 | 10/1973 | Krickovich | 37/24 X |
| 4,084,643 | 4/1978 | Easterling | 172/795 |

FOREIGN PATENT DOCUMENTS

| | | | |
|---|---|---|---|
| 603735 | 8/1960 | Canada | 37/43 G |
| 2034508 | 6/1972 | Fed. Rep. of Germany | 37/22 |
| 521276 | 3/1955 | Italy | 172/98 |
| 125808 | 6/1959 | U.S.S.R. | 37/24 |

*Primary Examiner*—Edgar S. Burr
*Assistant Examiner*—Moshe I. Cohen

[57] ABSTRACT

Snow removal apparatus for attachment to a rail vehicle in which a rotary snow plow having a pair of coaxial milling cylinders is mounted in a common housing and synchronously driven through a common drive transmission. The housing is mounted to the front end of the vehicle by a first supporting member extending along the width of the vehicle and securely fixed thereto and a second supporting member on which the rotary housing is pivotally held. The second supporting member is adapted to slidably engage with and be held on the first supporting member so that it may be laterally shifted in the horizontal plane, on the fixed supporting member from side to side of the vehicle.

4 Claims, 4 Drawing Figures

1
III
6a
5
4
6
3
9
10
12
19a
25
18
8
15
14
13
21
22
20
23

1
III
2
24
3
5
17
12
13
7
9
15
19
18
14
11
16
8
10
4
6
25
20
23

5
12
34
30
32
10

12
5a
10a
5
10
8
9
6
6b

SNOW PLOW FOR RAILED VEHICLE

BACKGROUND OF THE INVENTION

The present invention relates to the mounting of snow removal equipment on rail vehicles and, in particular, to apparatus permitting the side to side shifting of the equipment in front of the vehicle.

When cleaning heavily snow-covered rights-of way, it is a known requirement that the path be cleared wider on the inside of a curve than on the outside. However, when long trains, or long cars, are employed, lateral sweeping of the snow along the snow wall on the inner curve is to be avoided.

In German Pat. No. 2,034,508 there is illustrated a rail vehicle equipped with snow removal apparatus comprising two snow blowers mounted independently of each other and displaceable horizontally outward from the central longitudinal axis of the vehicle, so that each snow blower moves from the center line outwardly to either the right or left respectively. The use of this equipment, so that the snow blowers extend laterally from one side, presupposes that the distance between the snow blowers has first been cleared, with the snow blowers moved together and abutting each other, since otherwise an uncleaned central strip would remain barring movement of the vehicle. Thus, in order to clear the sides of the right way, the vehicle must make two passes over the same track, first to clear the center, and second to clear the sides. Further, since each of the snow blowers are independent there is provided two housings, each having an ejection stack. Consequently, no matter how the blowers are shifted, they impair the vision of the vehicle driver. Still further, each of the snow blowers is driven by its own motor; as a result, the snow blowing operation is affected at only half of the power relative to that available if they were driven directly from a drive source mounted on the vehicle itself.

SUMMARY OF THE INVENTION

According to the present invention, improved snow removal equipment for mounting to the front of a railed vehicle is provided wherein the disadvantages described above are avoided.

According to the present invention, the snow removal apparatus comprises a rotary snow plow having a pair of coaxial milling cylinders mounted in a common housing and synchronously driven through a common drive transmission. The snow plow is mounted to the front end of the vehicle by a first supporting member extending along the width of the vehicle and securely fixed thereto and a second supporting member on which the rotary snow plow is held. The second supporting member is adapted to slidably engage with and be held on the first supporting member so that it may be laterally shifted in the horizontal plane, on the fixed supporting member from side to side of the vehicle.

The rotary snow plow is suspended pivotally on the second supporting member so that its inclination or distance from the ground can be varied. To effect this, it is preferred that the housing be pivotally connected by suitable articulating joints adjacent its lower end and that a hydraulically operated push-pull rod connected to its upper end, which can be remotely operated by the driver of the vehicle.

The lateral displacement of the rotary snow plow in front of the vehicle is preferably obtained by a hydraulic drive mechanism, which is connected to a source of hydraulic fluid and controls operable by the driver of the vehicle so that displacement is possible during movement of the vehicle. In lieu of a hydraulic drive mechanism, suitable mechanical drive means can be provided.

Full details of the present invention are set forth in the following description and are shown in the accompanying drawings.

DESCRIPTION OF THE INVENTION

Figure 4:
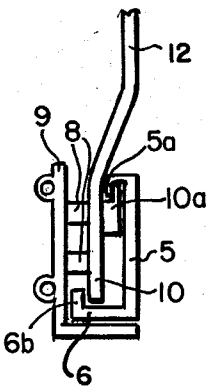
FIG. 4 is an enlarged sectional view taken in the direction IV—IV of FIG. 2.

As seen in the Figures, a road vehicle 1, converted for use on rails 23 by the mounting of flanged wheels 24 is provided at its lower front end with one or more assemblies of depending extensions 2 welded or otherwise suitably integrally secured to the chassis. An intermediate mounting piece 3 is similarly welded or secured to the depending extension 2 and a vertical carrying plate 4 is similarly affixed thereto so as to extend substantially vertically with the ground. Securely welded, bolted or otherwise affixed to the vertical carrying plate 4 substantially across the width of the vehicle is a horizontally extending support member 5. The support member 5 is L-shaped in cross-section and has its short leg 6 reinforced by transverse ribs **6*a* extending in a plane horizontal to the ground. As seen in detail in FIG. 4, the top edge of support member 5 is provided with a downwardly directed flange 5*a* which is spaced from the plate 5. The edge of the short leg 6 is provided with an upwardly directed flange 6*b*. The flanges 5*a* and 6*b* provide, in combination with the support member 5 and leg 6** upper and lower hook members, respectively.

Mounted on the L-shaped support member 5 by means of a supporting assembly generally denoted by the numeral 7, is a rotary snow plow generally depicted by the numeral 11. The supporting assembly 7 comprises a pair of plate members 9 and 10 spaced from each other and integrally interconnected by connecting bridges 8. The member 9 is L-shaped in cross-section, while the member 10 is shaped and profiled to have a flat section extending parallel to the long leg of the member 9. A curved upwardly extending arm 12 is provided at each of the upper corners of the member 10 for a purpose which will be later explained. The flat portion of the member 10 is shorter (vertically) than that of the long leg of the member 9 and is spaced from the upper surface of the short leg of the member 9 by a distance equal to the thickness of the horizontal leg 6 of the supporting member 5. Welded or otherwise securely fastened to the back of the plate 10 is horizontal rib **10*a* which is cut back at its upper edge so as to fit under the flange 5*a*. The two parts 9 and 10 are, therefore, capable of engaging about short leg 6 with the short leg of the member of part 9 below the short leg 6 and the edge of the member 10 above the upper surface thereof, and with the rib 10***a* hooked beneath flange 5*a*. The flange 6*b* holds the lower edge of the plate 10 from falling off the short leg 6. As a result, the entire assembly 10 is caused to slidably rest and engage with the mounting member 5 and while being slidable in the horizontal direction across the width of the vehicle, is secured against tipping with respect thereto.

Figure 1:
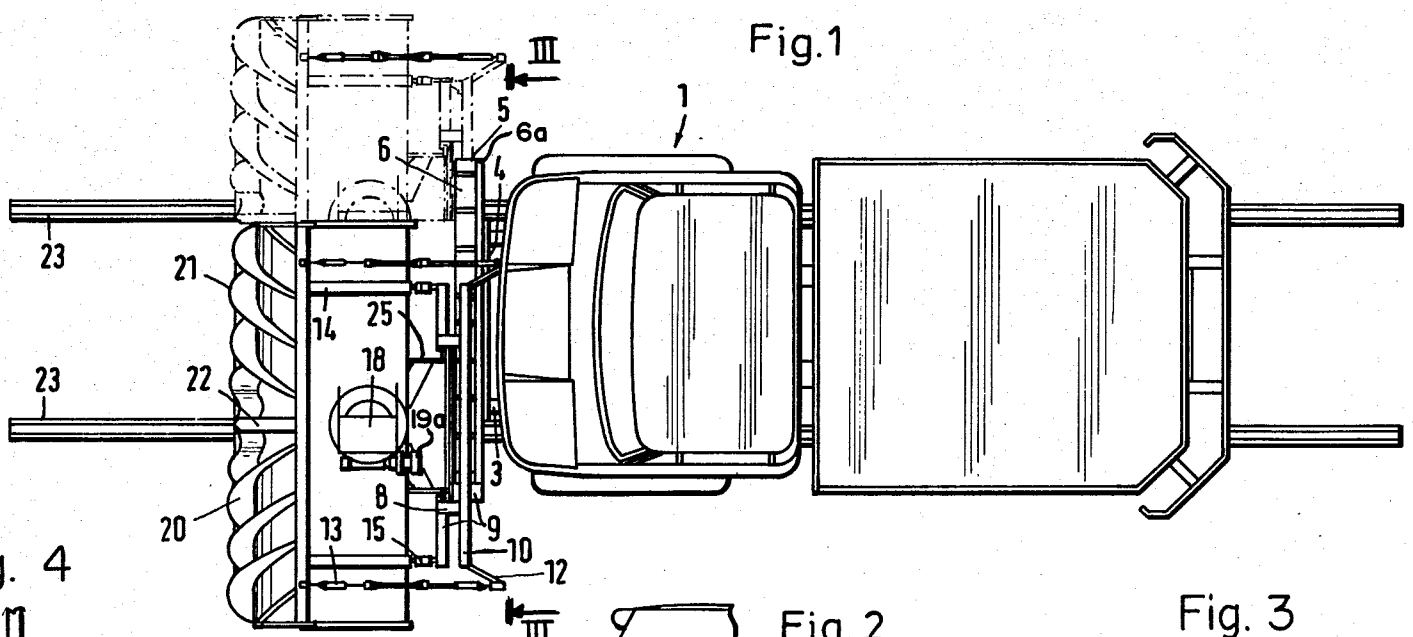
FIG. 1 is a plan view illustrating the snow removal equipment mounted on a rail vehicle in accordance with the present invention.
Figure 2:
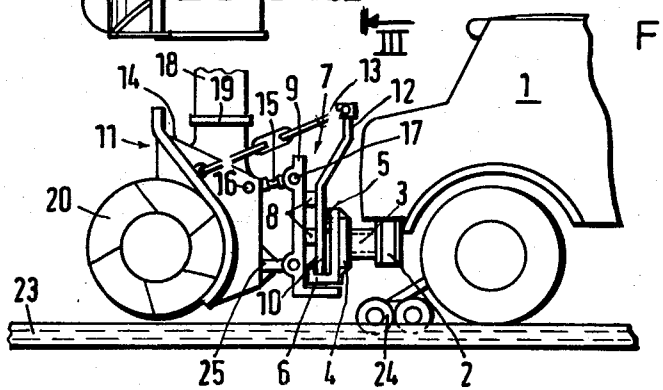
FIG. 2 is a side elevational view of the equipment and vehicle shown in FIG. 1.
Figure 3:
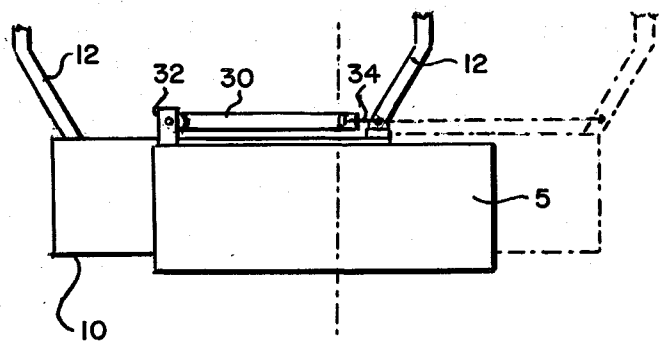
FIG. 3 is a view taken in the direction of line III—III of FIG. 1.

The supporting assembly 7 is also held in the vertical position shown in FIGS. 1 and 2, and shiftable from side to side by the hydraulic cylinder 30 illustrated in FIG. 3. One end of the cylinder 30 is secured to a block 32, welded or otherwise integrally secured to the support member 5 at its left end and extending slightly above its upper edge. The piston 34 extending from the cylinder 30 is connected to the upwardly extending arm 12 at the opposite or right side. The hydraulic cylinder 30, is connected to a source of fluid under pressure, controllable by suitable valves, switches etc. from the interior of the vehicle 1, so that it is selectively actuated in opposite directions. As a result, the entire supporting assembly 7 for the snow plow can be shifted automatically from side to side, as seen in the solid lines, and dot-dash lines of FIG. 1. Thus, with the piston rod fully extended the supporting assembly is shifted to the right and with the rod fully retracted it is shifted to the left. When the rod is centered in the cylinder, the supporting assembly is also centered.

The rotary snow plow assembly 11 comprises a single housing 14 in which a pair of milling plows 20 and 21 are rotatably mounted. The housing 14 is secured, at its lower end by two or more fixed pivots 25, to the front wall of the mounting member 9. The housing 14 is also secured at its upper portion by two or more variable length links 15 secured pivotally at points 16 and 17 to the housing and to the mounting member 9 respectively. The variable length link 15 may be, for example, a telescoping screw and threaded cylinder or a spring loaded piston and cylinder arrangement. Also connected to the upper end of the housing 14 is one or more adjustable push-pull rod members 13 having one end connected to the upwardly extending curved arm of the mounting part 12 and its other end connected to a forward portion of the housing 14. The push-pull rods 13 may be conventional turn buckle members, having threaded rods engaging with a female sleeve, which may be manually adjusted. On the other hand, the pull rod 13 can be provided with a hydraulic piston cylinder so that its length can be remotely controlled by the operator.

The rotary snow plow members 20 and 21 are provided with helical and/or other shaped milling formations and are driven through a drive transmission system such as that shown in U.S. Pat. No. 3,795,068 to which reference is herein made or other conventional drive and miter or bevel gear transmission. The transmission is supported in the interior of a central connecting ring 22. Each of the cylinders is mounted on half axles originating from the miter gear so that they are driven synchronously with respect to each other. The transmission is connected to a suitable power source, such as an electric motor, preferably mounted in the housing, and controlled from the vehicle.

The single housing is provided with an ejection stack 18 which is rotatable about its central axis by means of a rotary coupling 19. The ejection stack 18 is provided with a directional opening, which can thus be rotated by conventional screw means 19*a* either by hand or by motor to either side of the vehicle, as may be desired.

As seen in FIG. 1, the entire snow plow assembly is shifted to the left, relative to the direction of travel of the vehicle so that it projects laterally beyond the left side of the vehicle. The extreme right displacement of the plow assembly is indicated in the dot-dash lines. Preferably, the vehicle and the plow are a dimension such that the lateral displacement beyond the sidewalls of the vehicle is approximately half a meter in length, in either direction.

It will be seen from the foregoing, that a cleaning pattern can be accomplished by only a slight lateral displacement of the projecting snow plow in a single operation, i.e., in only one clearing trip. Only when especially wide paths are to be cleared, say up to a projection of half a meter on both sides, (referred to the width of normal rail vehicles), are two operations necessary; the plow assembly being displaced along the guide once to the right and once to the left on the outside. The danger of a snow strip remaining in the central track region does not, however, exist.

Further, the unilateral use of the plow assembly of the present invention insures that the entire drive power is available for the plow blowers. Due to the common drum housing, only one central ejection stack is required.

Various modifications and changes have been suggested and others will be obvious to those skilled in this art. Accordingly the present disclosure is to be taken as illustrative only of the present invention.

What is claimed is:

1. Apparatus for attachment to a rail vehicle for plowing snow along the right of way comprising an elongated housing extending the width of the rail vehicle having plow means mounted therein, said plow means comprising a pair of rotatable helical snow plows mounted side by side on a common axis and having transmission means comprising a common drive connection to each plow, attachment means for securing said housing to said rail vehicle, comprising a first support and guide member attached to the front end of said rail vehicle and extending substantially across the width thereof, and a second support and guide member articulatingly secured to said housing for pivotal movement with respect to the ground, means to enable said plow means to clear a path for said rail vehicle in a single pass consisting of means to permit movement of said plow means from side to side transversely of said rail vehicle, said last named means including mounting said first and second support and guide members for cooperable slidable interengagement across the width of said first member whereby said second member and the housing secured thereto are movable from side to side across the width of said rail vehicle to carry said plows from side to side.

2. The apparatus according to claim 1, wherein said first support and guide member comprises an elongated first plate, L-shaped in cross section, the longer leg of said first plate being affixed to the rail vehicle and the shorter leg of said first plate extending forwardly therefrom substantially across the width of said rail vehicle, the second support and guide member comprises a second elongated plate L-shaped in cross section, and a vertical plate member arranged parallel to the long leg of said second plate, means for interconnecting the long leg of said second plate, whereby the short leg of said first plate is insertable in interlocking engagement within said space.

3. The apparatus according to claim 1 including extensions projecting upwardly from the upper corners of said second support member, and adjustable means connecting said extensions and the housing.

4. The apparatus according to claim 3 including adjustable connections between said housing and said second support member intermediate the upper and lower edges thereof.

* * * * *